US008395510B1

(12) United States Patent
Kirk

(10) Patent No.: US 8,395,510 B1
(45) Date of Patent: Mar. 12, 2013

(54) KIT AND SYSTEM FOR MONITORING A PERSON

(76) Inventor: Tammy Lynn Kirk, Houston, TX (US)

( * ) Notice: Subject to any disclaimer, the term of this patent is extended or adjusted under 35 U.S.C. 154(b) by 652 days.

(21) Appl. No.: 12/577,887

(22) Filed: Oct. 13, 2009

Related U.S. Application Data

(60) Provisional application No. 61/243,348, filed on Sep. 17, 2009.

(51) Int. Cl.
*G08B 23/00* (2006.01)

(52) U.S. Cl. ..... 340/573.1; 340/539.12; 600/300

(58) Field of Classification Search ..... 340/539.12, 340/573.1; 600/300, 301
See application file for complete search history.

(56) References Cited

U.S. PATENT DOCUMENTS

| | | | | |
|---|---|---|---|---|
| 6,160,478 | A * | 12/2000 | Jacobsen et al. | 340/539.12 |
| 6,377,177 | B1 | 4/2002 | Broussard et al. | |
| 6,858,006 | B2 * | 2/2005 | MacCarter et al. | 600/300 |
| 6,975,230 | B1 | 12/2005 | Brilman | |
| 7,336,187 | B2 * | 2/2008 | Hubbard et al. | 340/573.1 |
| 2008/0045815 | A1 * | 2/2008 | Derchak et al. | 600/301 |
| 2009/0322513 | A1 * | 12/2009 | Hwang et al. | 340/539.12 |

* cited by examiner

*Primary Examiner* — Thomas Mullen
(74) *Attorney, Agent, or Firm* — Buskop Law Group, PC; Wendy Buskop

(57) ABSTRACT

A system and kit for monitoring infants and people. The systems and kits can include one or more sensors in communication with one or more contact devices. The system and kit can ensure that infants are breathing and that at least one caregiver receives an alert when an infant stops breathing. The system and kit can also provide alerts and alarms when other sensed data is not within predetermined value ranges.

8 Claims, 9 Drawing Sheets

KIT AND SYSTEM FOR MONITORING A PERSON

CROSS-REFERENCE TO RELATED APPLICATIONS

The present application claims priority and the benefit of U.S. Provisional Patent Application Ser. No. 61/243,348 filed on Sep. 17, 2009, entitled "Method, Apparatus, and Kit for Monitoring a Person". This reference is hereby incorporated in its entirety.

FIELD

The present embodiments generally relate to a kit and system for monitoring a person. In one or more embodiments, the kit and system can include one or more sensors in communication with one or more devices. The present embodiments further relate to a system and kit for monitoring infants to ensure that the infants are breathing and that at least one caregiver receives an alert if an infant stops breathing.

BACKGROUND

A need exists for a digital notification system for a plurality of infants in a facility that simultaneously informs a plurality of caregivers responsible for the plurality of infants through a variety of different devices when one or more of the plurality of infants stops breathing.

A need exists for a digital notification system that informs a caregiver within sixty seconds of when an infant stops breathing.

A need exists for a digital notification system that is easy to use, is not language specific, and can handle multiple situations simultaneously.

A further need exists for a digital notification system for alerting multiple caregivers, wherein the caregivers can be a distance ranging from within a few feet of the infant to within several floors from the infant or plurality of infants.

A need exists for a digital notification system that can notify caregivers within less than 100 feet from a plurality of infants, while simultaneously alerting a crisis team to the infant or plurality of infants who have stopped breathing. The crisis team can be a group of first responders who may be located far from the plurality of infants.

A need exists for a wearable system that can be attached to a plurality of infants for remote monitoring by a single administrative party to detect changes in breathing patterns, for which such patterns may be a signal of an onset of SIDS.

The present embodiments meet these needs.

BRIEF DESCRIPTION OF THE DRAWINGS

The detailed description will be better understood in conjunction with the accompanying drawings as follows.

Figure 1:
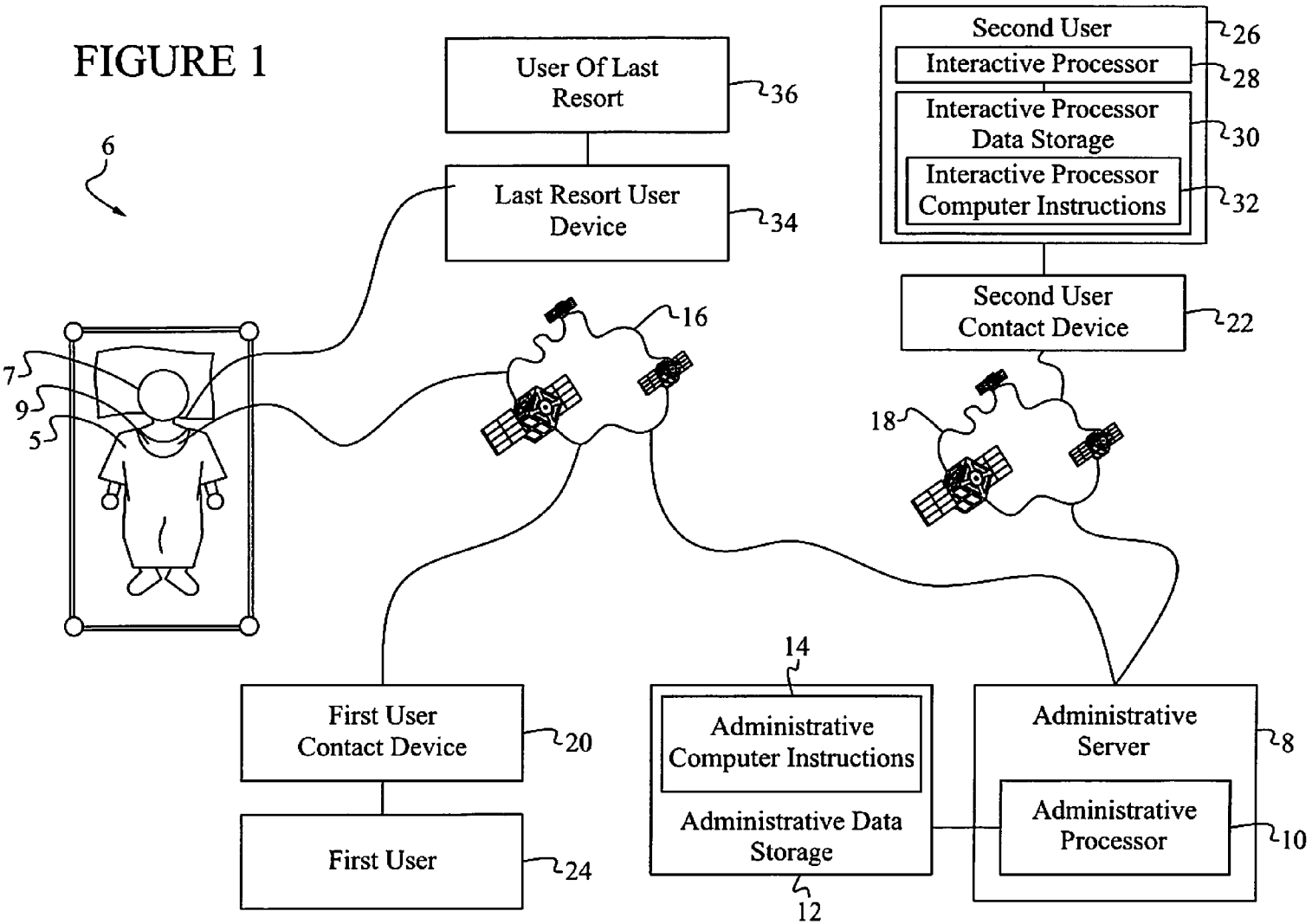
FIG. 1 shows an embodiment of a system for monitoring carbon dioxide levels.

The present embodiments are detailed below with reference to the listed Figures.

DETAILED DESCRIPTION OF THE EMBODIMENTS

Before explaining the present kit and system in detail, it is to be understood that the kit and system are not limited to the particular embodiments, and the embodiments can be practiced or carried out in various ways.

The present embodiments relate to a carbon dioxide sensing and notification system and kit for use with one or more networks to simultaneously communicate directly with one or more contact devices to notify caregivers that one or more infants has stopped breathing due to SIDS.

The term "SIDS" as used herein refers to Sudden Infant Death Syndrome.

Embodiments of the invention may prevent death, brain damage, and other serious or fatal injuries to infants by providing a notification when an infant experiences a life threatening circumstance, such as SIDS.

Embodiments of the invention can provide for continuous and non-stop monitoring of a plurality of infants. Therefore, the embodiments reduce time spent to continually check on a large number of infants, such as in a hospital.

Embodiments of the invention can provide parents, medical personnel, and other caregivers with a greater degree of confidence that an infant is not experiencing SIDS or any other ailments, which could cause a loss of breathing. The caregiver then has more time to dedicate attention to other tasks because the necessity of constantly inspecting an infant for SIDS is reduced or eliminated.

One or more embodiments of the kits and systems for monitoring a person can allow hospital personnel to dedicate time and energy to other life saving tasks required of them. Embodiments of the kits and systems for monitoring a person can allow parents to rest easier at night, experience less stress, and get more sleep, which leads to a more stress-free and productive society.

Embodiments of the invention can provide for automatic and fast notification to first responders, such as an ambulance, a doctor, or a nurse. This reduces any time delay between a recognition that an infant is experiencing SIDS and a response to the fact of the infant experiencing SIDS. Reducing the time delay between the SIDS recognition and the SIDS response is critical to saving the lives of more infants.

The embodiments of the invention can be used in an orphanage, a hospital, a neonatology unit, or a similar institution where multiple infants are being cared for by only a few people.

In embodiments, the invention can include a system to monitor carbon dioxide levels to prevent SIDS amongst a plurality of infants.

Embodiments of the system can include a wearable portion. The wearable portion can comprise a carbon dioxide sensor for detecting carbon dioxide output from an infant of a plurality of infants. As used herein, carbon dioxide output refers to the carbon dioxide exhaled by an infant or another person.

The wearable portion can also include a processor which can be in communication with the carbon dioxide sensor for receiving carbon dioxide sensor data and for comparing sensed carbon dioxide data to preset carbon dioxide limits. Carbon dioxide sensor data can include measured carbon dioxide levels.

A unique carbon dioxide limit, or a preset carbon dioxide limit, can be determined for each infant. Each carbon dioxide limit can be determined by an age, a weight, a gender, an ethnicity of the infant, as well as other factors. The preset carbon dioxide limit can be the level of carbon dioxide which a normal infant would exhale with each breath, or can be the level of carbon dioxide normally present proximate the mouth and/or nose of a healthy and breathing infant.

The wearable portion can include a data storage, which can be in communication with the processor of the wearable portion, for storing preset carbon dioxide limits and computer instructions.

Computer instructions stored on the data storage of the wearable portion can provide instructions to the processor on the wearable portion. The computer instructions stored on the data storage of the wearable portion can include: computer instructions for forming a database of preset carbon dioxide limits; computer instructions to receive additional preset carbon dioxide limits and to store the additional preset carbon dioxide limits in the data storage; computer instructions to compare sensed carbon dioxide output from an infant of a plurality of infants to the preset carbon dioxide limits, forming a compared value; computer instructions to form and transmit a message to at least one user contact device indicating when the compared value falls below or exceeds the unique preset carbon dioxide limit for any of the plurality of infants; computer instructions to provide interval transmissions of the compared value; computer instructions to simultaneously provide an emergency transmission to all user contact devices; or combinations thereof.

The interval transmissions can be repeated regular transmissions of a signal sent from the wearable portion to the administrative server or sent to the user of last resort. The interval transmissions can contain the compared value. The compared value can be the carbon dioxide output levels minus the preset carbon dioxide limit. A positive compared value occurs when the carbon dioxide output levels are greater than the preset carbon dioxide limit, which creates a positive ratio. A negative compared value occurs when the carbon dioxide output levels are lower than the preset carbon dioxide limit, which creates a negative ratio. A negative value further indicates a breathing problem and a possible SIDS diagnosis.

The system can include a signal transmitter in communication with the wearable portion processor in order to transmit outgoing signals. The system can also include a signal receiver for receiving incoming signals for communicating with the processor of the wearable portion.

Power can be provided to the system by connecting a battery to the system, wherein the system can include a carbon dioxide sensor, a wearable portion processor, a signal transmitter, and a signal receiver.

The system can include an administrative server with an administrative processor and with an administrative data storage. The administrative data storage can comprise administrative computer instructions. The administrative server can be in communication with the wearable portion by a first network.

The system can further include a plurality of user contact devices. Each user contact device can include a contact device processor, a contact device data storage, and contact device computer instructions. Each user contact device can be in communication with the administrative server through the first network, a second network, or a combination of first and second networks.

An embodiment of the invention can include a last resort user contact device. The last resort user contact device can be in direct communication with the wearable portion, rather than communicating through the administrative server. In the instance that a failure of the administrative server occurs, a message, a notification, or an alarm can still be received by the last resort user contact device.

In an embodiment, the administrative computer instructions can comprise: computer instructions for forming at least one message; computer instructions for transmitting at least one message; computer instructions to ensure contact with each user contact device; computer instructions to divide bandwidth to ensure continued use through a local switch; computer instructions to generate a report; computer instructions to track a date when a message was transmitted to a user contact device; computer instructions to track a time when a message was transmitted to a user contact device; computer instructions to obtain a global positioning system "GPS" location of an infant; computer instructions to retransmit the message to a user contact device closest to an infant; computer instructions to receive, store, and track GPS locations of user contact devices; computer instructions to track receipt of the message; computer instructions to display GPS locations of user contact devices on a map; computer instructions to allow information to be attached to the message, such as a location of a hospital; computer instructions to allow an administrator, a user, or combinations thereof, to see all GPS locations simultaneously; computer instructions to transmit information and the message from a plurality of systems to a single user contact device as an executive dashboard for monitoring a plurality of infants simultaneously; computer instructions to allow an administrator, a third party, or combinations thereof, to see all GPS locations of user contact devices; computer instructions to retransmit at least one message based on a geographically defined region; computer instructions to automatically transmit a status message at predefined time intervals; computer instructions to provide an alarm to the last resort user contact device when the message fails to communicate with a user contact device; or combinations thereof.

In an embodiment, the contact device computer instructions can comprise: computer instructions to receive information from the administrative server; computer instructions to display all infant carbon dioxide levels as the infant carbon dioxide levels are received from the carbon dioxide sensor for continuous monitoring; computer instructions to provide an audible sound, a vibration, or combinations thereof, when an infant's level of carbon dioxide falls below a carbon dioxide preset limit; computer instructions to provide a display on a map of any responders with an indication of GPS locations of the responders; computer instructions to provide responder contact information; computer instructions to transmit an alarm to the last resort user contact device on prompt; computer instructions to transmit an acknowledgement of message receipt from each user contact device to the administrative server; computer instructions to transmit a GPS location of each user contact device to the administrative server for continuous monitoring of the location of each user; or combinations thereof.

In an embodiment, the wearable portion can be sewn into clothing of an infant. The wearable portion can also be attached with Velcro™, or a material of similar attachability or detachability. The wearable portion can also be sewn or otherwise attached to a blanket of an infant.

A user of an embodiment can be a person, such as a first nurse, which can be a nurse immediately proximate the infant. Another user can be a second nurse not as close to the infant as the first nurse. Each user can further be a computer that sends additional messages or that notifies other caregivers nearby the infant.

The second network can be a global communication network, such as the Internet. In one or more embodiments, the second network can be a wireless cellular network. The first and second networks can be used for transmitting notifications, messages, alarms, and other signals. Messages can be transmitted by email, wireless cellular signals, instant messaging, or any other standard communication device or method.

The administrative server can transmit notifications to primary caregivers of infants, to secondary caregivers of infants, to an identified group of first responders, to a crisis team, or combinations thereof.

Combinations of user contact devices can be used such as cell phones, laptops, desk top computers, personal digital assistants, home alarm systems, and other forms communication, monitoring, and notification devices. The contact devices can be televisions that are interactive as well.

The last resort device can also provide an alarm if the carbon dioxide sensor gets disconnected from the network, or otherwise ceases to communicate through the network.

Turning now to the Figures, FIG. 1 shows an embodiment of the system 6 for preventing infant death, which is depicted including a wearable portion 9 disposed within a fabric such as a clothing item 5 worn by an infant 7. The wearable portion 9 is depicted within a hem of the clothing item 5 near the head of the infant 7.

The wearable portion 9 is shown in communication with an administrative server 8 through a first network 16. In an embodiment, the first network 16 can be a local area network (LAN), which can be in a hospital.

The administrative server 8 is further depicted with an administrative processor 10 electronically connected to an administrative data storage 12. The administrative data storage 12 is shown with administrative computer instructions 14. The administrative data storage 12 can be a removable data storage, such as a jump drive or a removable hard drive that is exterior to the administrative server. The administrative server 8 is also in communication with a second network 18.

The first network 16 and the second network 18 can each be in communication with at least one user contact device, which can be a cellular phone, a laptop, a pager, or another standard communication device. The first network 16 is shown in communication with a first user contact device 20 for a first user 24. The second network 18 is shown in communication with a second user contact device 22 for a second user 26.

In this embodiment, the first user 24 is a person and the second user 26 is a computer that includes an interactive processor 28 and an interactive processor data storage 30. The interactive processor data storage 30 is depicted with interactive processor computer instructions 32, such as computer instructions to deploy a message to a second group of people. For example, the second group of people can be a group of people meeting certain qualifications suitable to give aid for the circumstance, such as doctors.

The wearable portion 9 is further shown in communication with a last resort user contact device 34 associated with a user of last resort 36. For example, the user of last resort 36 can be a station nurse from a related unit where the infants are not located. The last resort user contact device 34 is shown in direct communication with the wearable portion 9, as compared to being in communication through the administrative server 8. If the network(s) or the administrative server are not functioning, the last resort user contact device 34 will still be able to receive signals from the wearable portion 9.

Figure 2:
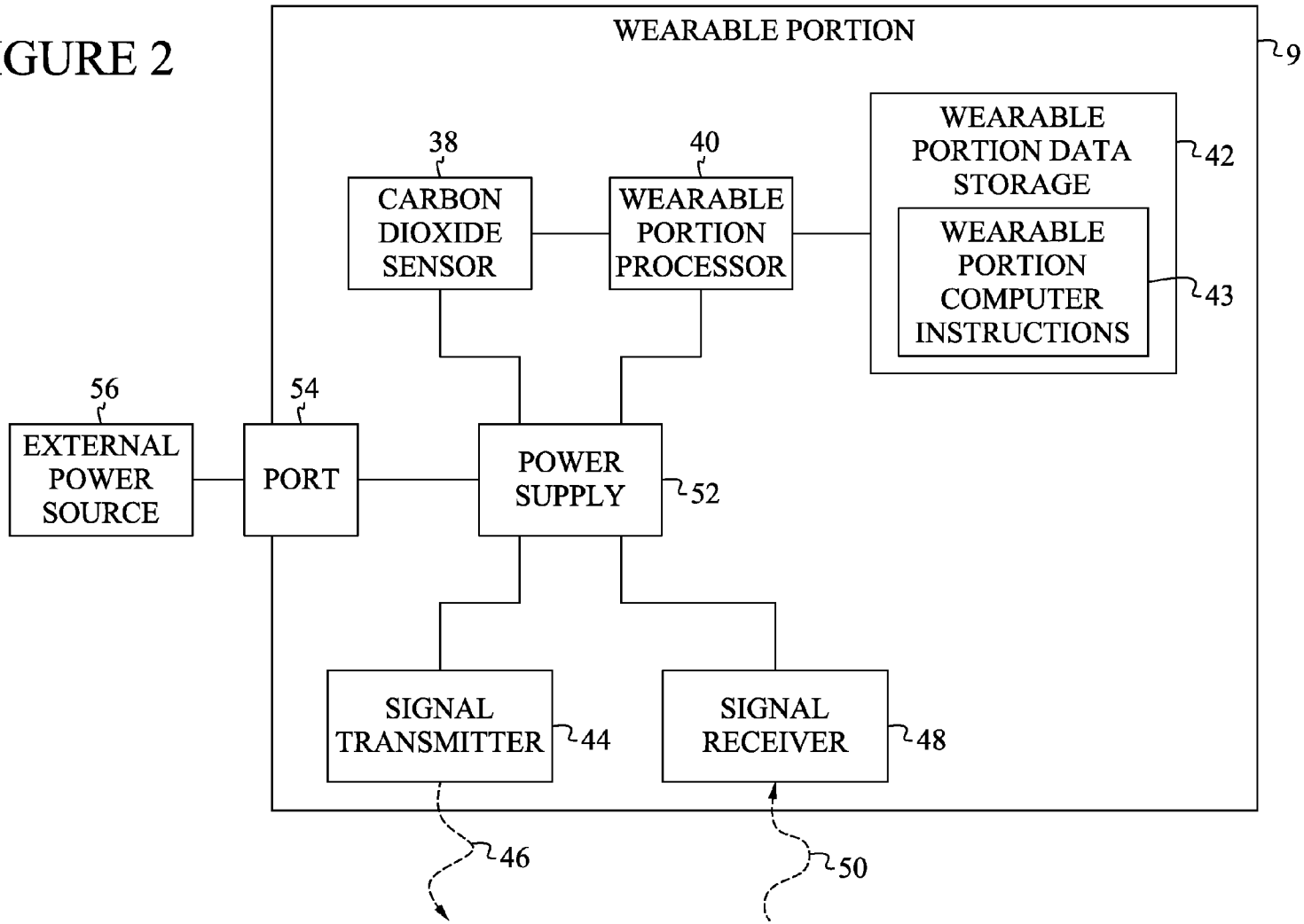
FIG. 2 shows an embodiment of a wearable portion.

FIG. 2 is a diagram of an embodiment of the wearable portion 9 of the system. The wearable portion 9 is depicted with a carbon dioxide sensor 38 connected to a wearable portion processor 40. The wearable portion processor 40 is shown in communication with a wearable portion data storage 42 with wearable portion computer instructions 43. The wearable portion processor 40 and the wearable portion data storage 42 can be disposed on a lightweight circuit board.

The wearable portion 9 can have a signal transmitter 44 that can transmit outgoing signals 46 of information from the carbon dioxide sensor 38.

The wearable portion 9 is shown with a signal receiver 48 that can receive incoming signals 50, which can initiate a monitoring step.

A power supply 52 can be included on the wearable portion 9 for providing power to the wearable portion 9. The power supply 52 can be a battery, such as a rechargeable battery, a lithium ion battery, a camera battery, a small battery, or any other suitable battery.

The power supply can have a voltage between about 1.2 volts to about 9 volts, or any other suitable voltage. The power supply 52 can have a port 54 for providing the wearable portion 9 with power from an external power source 56, or for recharging the power supply 52 when the power supply is a rechargeable battery.

Figure 3:
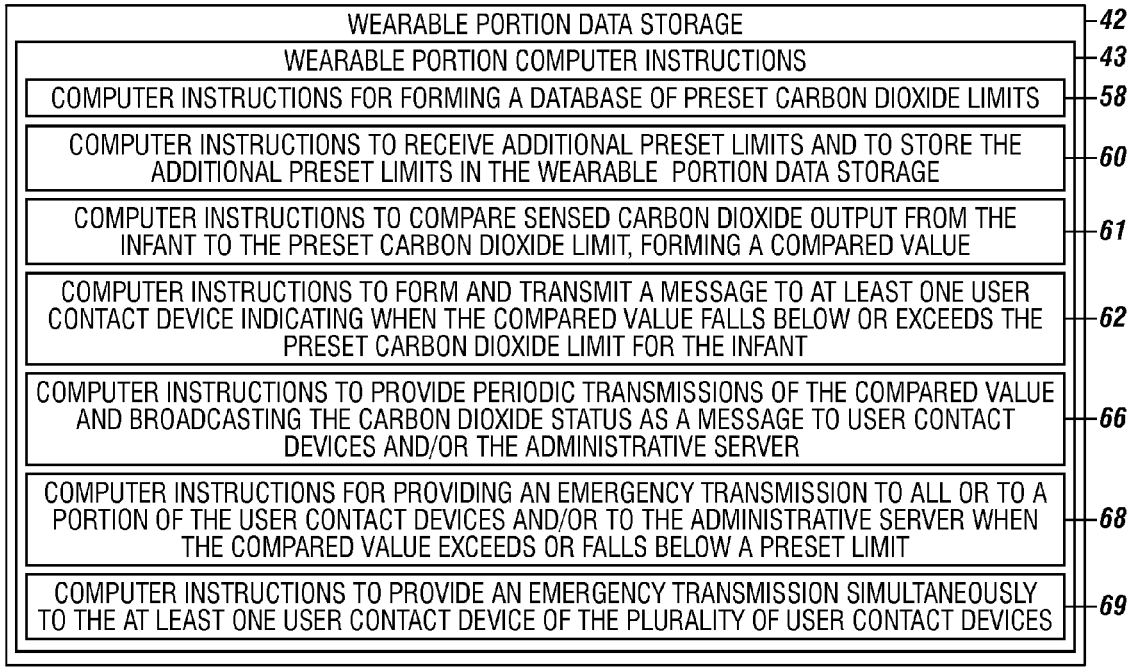
FIG. 3 shows an embodiment of computer instructions on the wearable portion data storage.

FIG. 3 is a detail of illustrative wearable portion computer instructions within the wearable portion data storage 42.

The wearable portion data storage 42 is shown with wearable portion computer instructions 43, which can include computer instructions for forming a database of preset carbon dioxide limits 58; computer instructions to receive additional preset limits and to store the additional preset limits in the wearable portion data storage 60; computer instructions to compare sensed carbon dioxide output from the infant to a preset carbon dioxide limit for the infant, forming a compared value 61; computer instructions to form and transmit a message to at least one user contact device of the plurality of user contact devices indicating when the compared value falls below or exceeds the preset carbon dioxide limit for the infant 62; computer instructions to provide periodic transmissions of the compared value and broadcasting the carbon dioxide status as a message to user contact devices and/or the administrative server 66; and computer instructions for providing an emergency transmission to all or to a portion of the user contact devices and/or to the administrative server when the compared value exceeds or falls below a preset limit 68; computer instructions to provide an emergency transmission simultaneously to the at least one user contact device of the plurality of user contact devices 69.

The carbon dioxide can be sensed and compared in terms of parts per million of carbon dioxide.

More than one administrative server can be used for monitoring between 3 and 300 infants simultaneously.

Figure 4A:
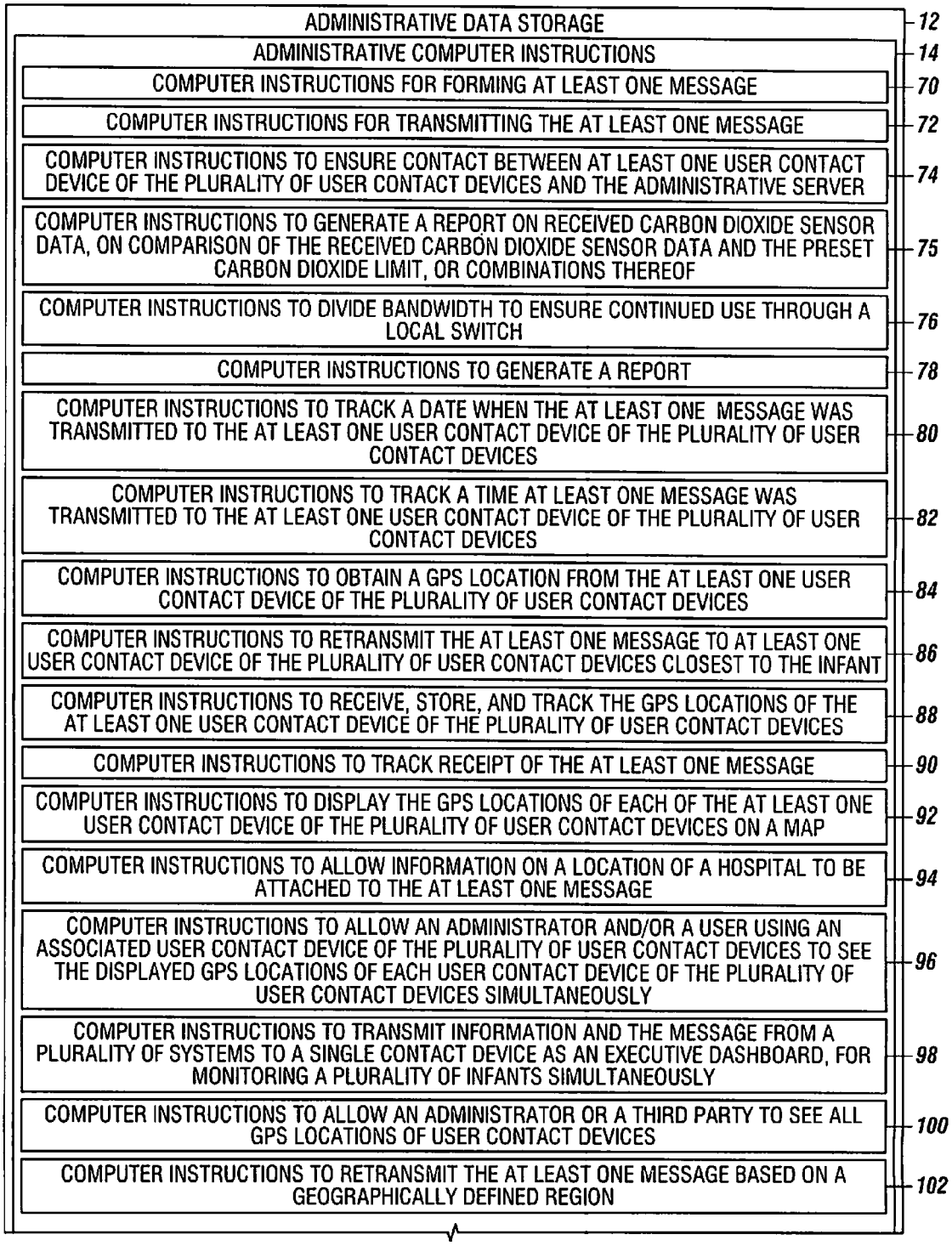
FIG. 4A shows an embodiment of computer instructions on an administrative data storage on the server of the system.
Figure 4B:
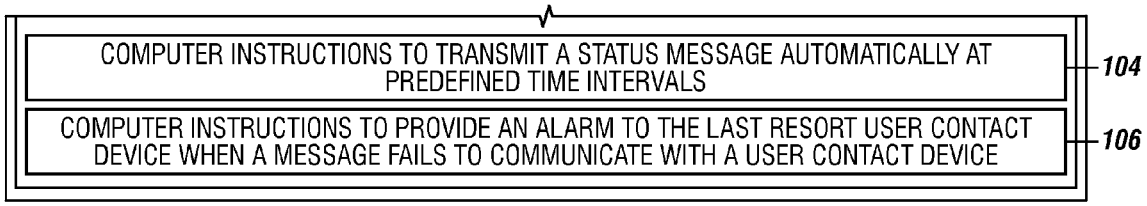
FIG. 4B is a continuation of FIG. 4A, and shows more computer instructions on an administrative data storage on the server of the system.

FIGS. 4A and 4B provide a detail of an embodiment of the administrative computer instructions 14 in the administrative data storage 12. The administrative data storage 12 can be in communication with the administrative processor 10. The administrative computer instructions can include computer instructions for forming at least one message 70; computer instructions for transmitting the at least one message 72; computer instructions to ensure contact between the at least one user contact device of the plurality of user contact devices and the administrative server 74; computer instructions to generate a report on received carbon dioxide sensor data, on the comparison of received carbon dioxide sensor data and the preset carbon dioxide limit, or combinations thereof 75; computer instructions to divide bandwidth to ensure continued use through a local switch 76; computer instructions to generate a report 78; computer instructions to track a date when the at least one message was transmitted to the at least one user contact device of the plurality of user contact devices 80; computer instructions to track a time at least one message was transmitted to the at least one user contact device of the plurality of user contact devices 82; computer instructions to obtain a GPS location from the at least one user contact device of the plurality of user contact devices 84; computer instructions to retransmit the at least one message to at least one user contact device of the plurality of user contact devices closest to the infant 86; computer instructions to receive, store, and track the GPS locations of the at least one user contact device of the plurality of user contact devices 88; computer instructions to track receipt of the at least one message 90; computer instructions to display the GPS locations of each of the at least one user contact device of the plurality of user contact devices on a map 92; computer instructions to allow information on a location of a hospital to be attached to the at least one message 94; computer instructions to allow an administrator and/or a user using an associated user contact device of the plurality of user contact devices to see the displayed GPS locations of each user contact device of the plurality of user contact devices simultaneously 96; computer instructions to transmit information and the message from a plurality of systems to a single contact device as an executive dashboard, for monitoring a plurality of infants simultaneously 98; computer instructions to allow an administrator or a third party to see all GPS locations of user contact devices 100; computer instructions to retransmit the at least one message based on a geographically defined region 102; computer instructions to transmit a status message automatically at predefined time intervals 104; and computer instructions to provide an alarm to the last resort user contact device when a message fails to communicate with a user contact device 106.

Caregivers can be dispatched to an infant in need based upon the GPS location of the caregiver, for providing assistance quickly in an emergency.

Figure 5:
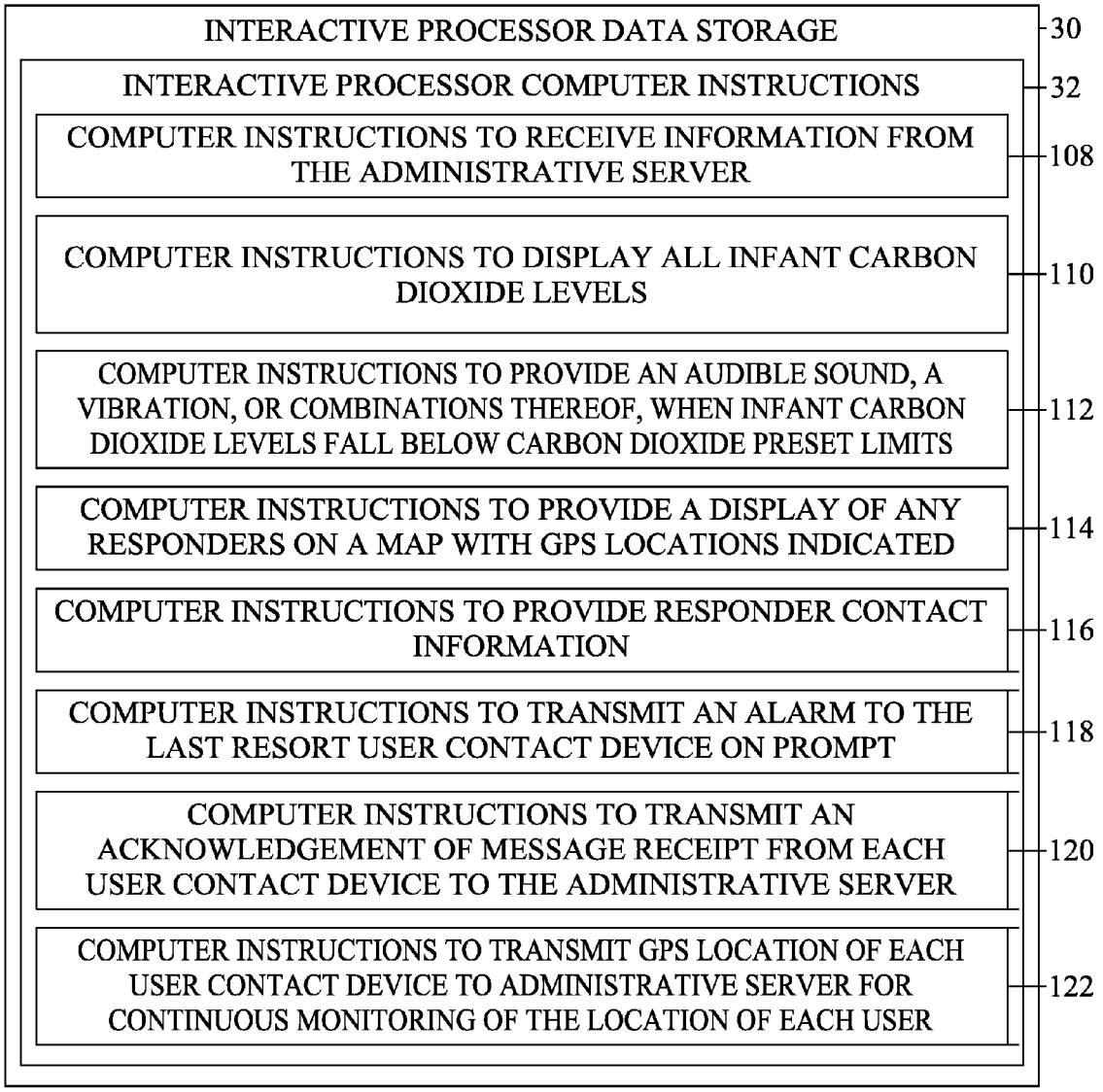
FIG. 5 shows an embodiment of computer instructions within an interactive processor data storage of the system.

FIG. 5 shows an embodiment of the interactive processor data storage 30 with interactive processor computer instructions 32 which can be located in the user contact devices. The interactive processor computer instructions 32 can include the following computer instructions directed towards the interactive processor: receive information from the administrative server 108; display all infant carbon dioxide levels 110; provide an audible sound or vibration when carbon dioxide levels fall below preset limits 112; provide a display of any responders on a map with GPS locations indicated 114; provide responder contact information 116 for fast response times which can be less than one minute, transmit an alarm to the last resort user contact device on prompt 118; transmit an acknowledgement of receipt of the message from the user contact device to the administrative server 120, transmit GPS locations of the user contact devices to the administrative server for continuous monitoring of the location of each user, such as caregivers 122.

Figure 6:
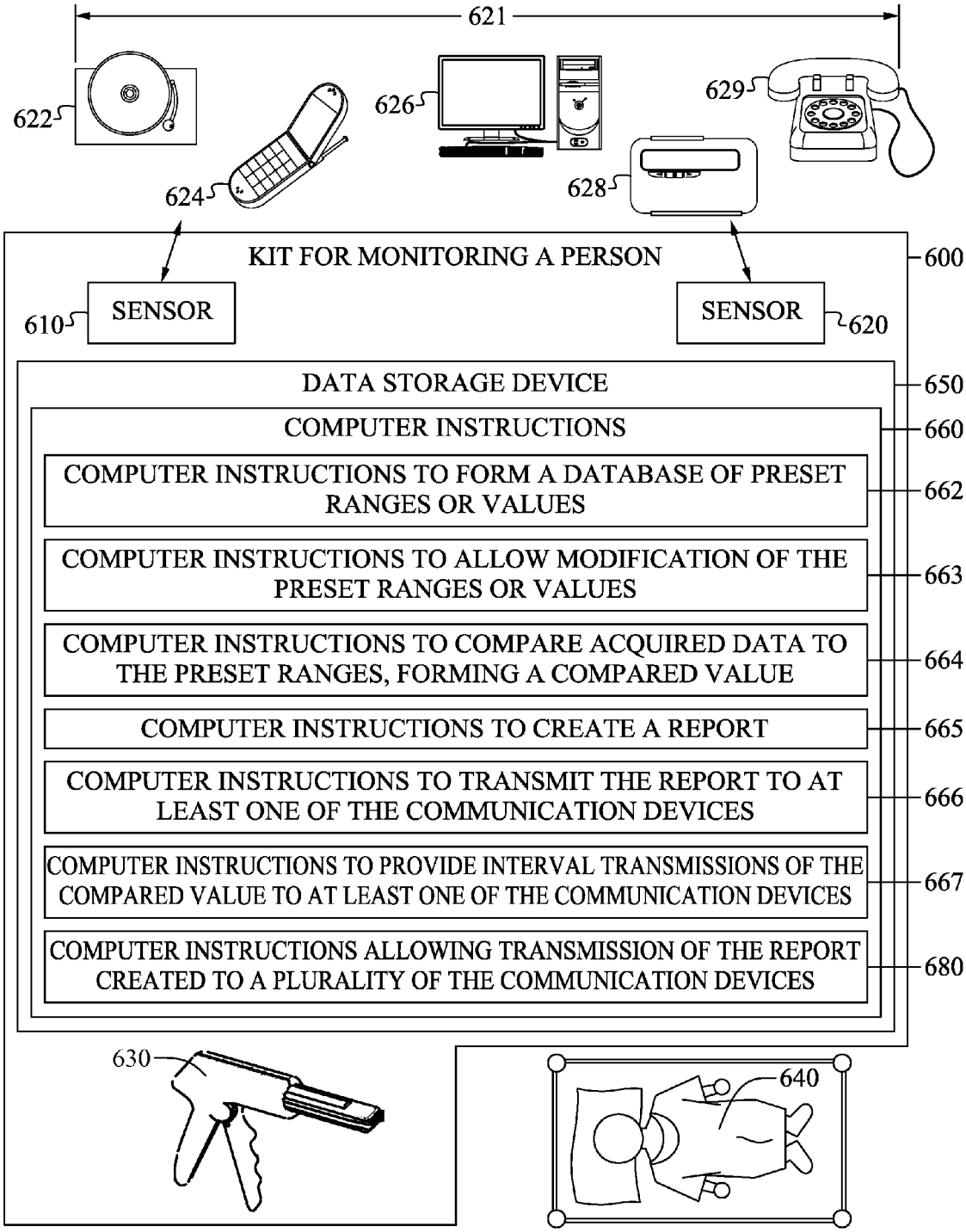
FIG. 6 shows a schematic view of a kit for monitoring a person.

FIG. 6 is a schematic view of a kit 600 for monitoring a person. The kit 600 can be used when monitoring an infant, an elderly person, or a sick person. The kit 600 can include one or more sensors, two sensors 610, 620 are shown in this Figure.

The sensors 610, 620 can be accelerometers, carbon dioxide sensors, oxygen sensors, motion sensors, heat sensors, pulse sensors, or other sensors. The sensors 610, 620 can be adapted to communicate with one or more communication devices 621.

The communication devices 621, which can be part of the kit 600 or independent from the kit, can include at least one of the following: a house alarm system 622, a cell phone 624, a personal computer 626, a pager 628, a land line 629, or another communication channel or device. Another communication channel or device can include a radio frequency transmitter and receiver, a fiber optic communication cable, a satellite, or other communication devices, networks, or mechanisms.

The sensors 610, 620 can communicate with one or more of the communication devices 621 independent of one another or simultaneously. The sensors 610, 620 can communicate with the communication devices 621 at predetermined intervals. For example, the sensors 610, 620 can acquire data and transmit the data to at least one of the communication devices 621 every 30 seconds. The predetermined interval can be from about every second to about every hour.

The kit 600 can also include one or more devices 630 for removably attaching the sensors 610, 620 to an item 640. The item 640 can be independent from the kit or part of the kit. The item 640 can be a blanket, a swaddler, a crib, a wheel chair, a car seat, a bed mattress, a shirt, a sleeper, a pillow, a sheet, a hat, a glove, an incubator, a necklace, another similar item, or combinations thereof.

The kit 600 can also include a data storage device 650. The data storage device 650 can be a flash drive, a CD disk, a floppy disk, a remote data storage accessible over a network, such as the internet.

A code can be provided with the kit 600. The code can be activated via the network, or similar data storage devices. The data storage device 650 can have a set of computer instructions 660 installed thereon.

The set of computer instructions 660 can include computer instructions to form a database of preset ranges or values 662; computer instructions to allow modification s to the preset ranges or values 663; computer instructions to compare acquired data to the preset ranges, forming a compared value 664; computer instructions to create a report 665; computer instructions to transmit the report to at least one of the communication devices 666; and computer instructions to provide interval transmissions of the compared value to at least one of the communication devices 667.

In one or more embodiments, the data storage device 650 can be placed in communication with one of the communication devices 621, such as the personal computer 626. The set of computer instructions 660 can be installed and/or uploaded onto the personal computer 626, for example onto the hard drive of the personal computer. After the set of computer instructions 660 are downloaded or stored on one or more of the communication devices 621, the communication devices 621 with the set of computer instructions 660 loaded thereon can communicate with the other communication devices 621.

In one or more embodiments, the set of computer instructions 660 can include computer instructions 680 allowing transmission of the report created using computer instructions to a plurality of the communication devices 621. The report can be transmitted to the plurality of devices 621 simultaneously.

In operation, the sensors 610, 620 can be attached to the item 640, which is on or proximate to the person to be monitored, such as an infant. The set of computer instructions 660 can be loaded onto one of the communication devices 621, such as the personal computer 626. The sensors 610, 620 can acquire data and transmit the acquired data to the personal computer 626 at predetermined time intervals. The personal computer 626 can monitor the acquired data, and send alerts to other communication devices 621, reports to other communication devices 621, or sound an alarm when the acquired data indicates that the person being monitored has stopped breathing, has moved outside of a predetermined area, has a dangerous increase in pulse or heart rate, or a dangerously low or high temperature. The personal computer 626 can communicate with a plurality of the communication devices 621 over a network or through other forms of wired or wireless telemetry.

For example, the sensor can acquire data related to carbon dioxide levels, temperature, pulse rate, movement, or location. The acquired data can be transmitted to a processor, monitoring device, or personal computer using wired or wireless telemetry. For example, the sensors can have built in transmitters and can send the acquired data to a personal computer over a network.

The acquired data can be compared to a predetermined value. The predetermined value or preset range can be any value preset by an operator or user of the system. For example, the predetermined value can be the baseline carbon dioxide content that indicates a person is breathing, and as such if the sensor acquires data on carbon dioxide content that is below the predetermined baseline value, an alert can be generated.

The alert can be generated when the acquired data indicates a critical situation when compared to the predetermined value. For example, if the acquired data is below a baseline value as described above, is outside an acceptable range of the predetermined value, or otherwise indicates a problem or critical situation when compared to the predetermined value the alert can be generated. For example, an alert can be generated if the person being monitored has moved away from a preset location, such as a predetermined longitudinal line and latitudinal line. Generating the alert can include transmitting a signal to at least one of a house alarm system, a cell phone, a personal computer, a pager, and a land line. In one or more embodiments, generating an alert can also include sounding an alarm. The sounding of the alarm and the transmission of a signal to at least one of a house alarm system, a cell phone, a personal computer, a pager, and a land line can occur simultaneously.

A report can be generated on all the acquired data. For example, the acquired data can be sent to a processor or monitoring device and the monitoring device or processor can generate a weekly, daily, monthly or hourly report on all the acquired data.

Figure 7:
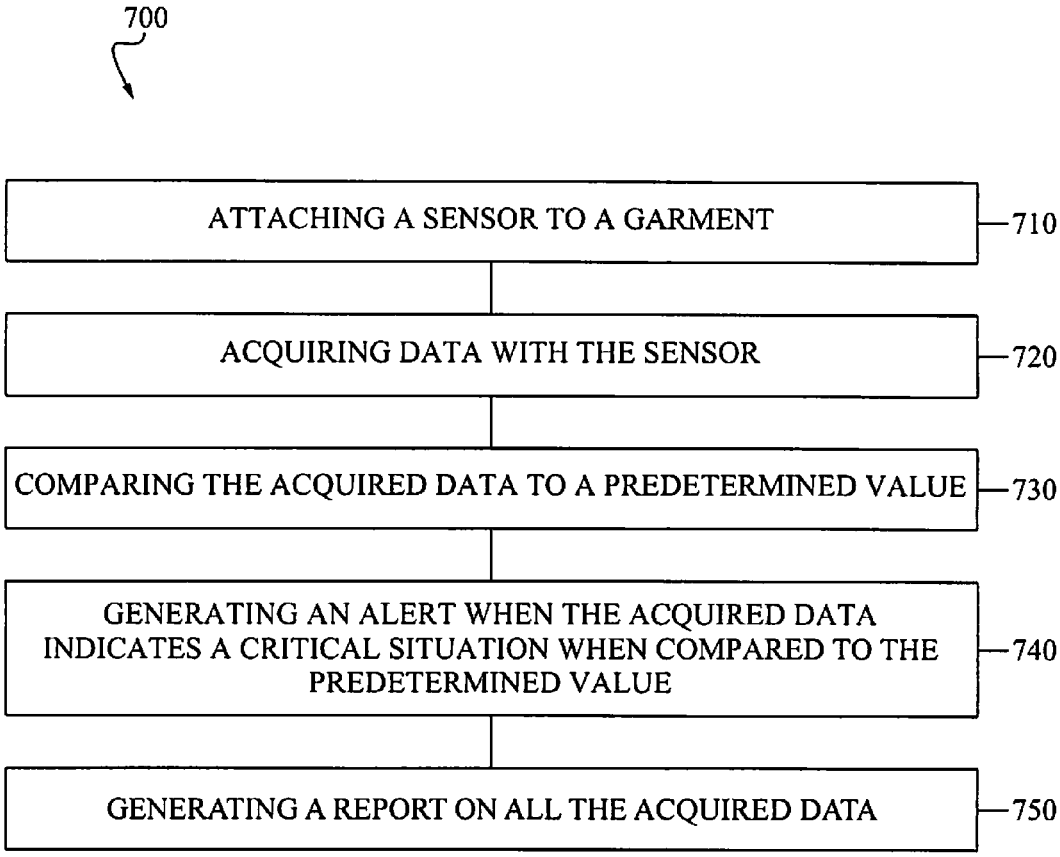
FIG. 7 is a flow diagram of an illustrative method for monitoring a person.

FIG. 7 is a flow diagram of a method for monitoring a person 700. The method for monitoring a person 700 can include attaching a sensor to a garment 710. The sensor or sensors can be accelerometers, global positioning systems, carbon dioxide sensors, oxygen sensors, motion detectors, decibel detectors, heat sensors, or a combination thereof. For example, an accelerometer, thermocouple, or carbon dioxide sensor can be attached to an infants sleeper by the use of a clamping device. In other embodiments, the garment can be a swaddler, a blanket, a hat, a glove, or combinations thereof.

The method can include acquiring data using the sensor 720. For example, the sensor can acquire data related to carbon dioxide levels, temperature, pulse rate, movement, or location. The acquired data can be transmitted to a processor, monitoring device, or personal computer using wired or wireless telemetry. For example, the sensor can have a built in transmitter and can send the acquired data to a personal computer over a network.

The method can include comparing the acquired data to a predetermined value 730. The predetermined value can be any value preset by an operator or user of the system. For example, the predetermined value can be the baseline carbon dioxide content that indicates a person is breathing, and as such if the sensor acquires data on carbon dioxide content that is below the predetermined baseline value, the method can include generating an alert.

The alert can be generated when the acquired data indicates a critical situation when compared to the predetermined value 740. For example, if the acquired data is below a baseline value as described above, is outside an acceptable range of the predetermined value, or otherwise indicates a problem or critical situation when compared to the predetermined value the alert can be generated. For example, an alert can be generated if the person being monitored has moved away from a preset location, such as a predetermined longitudinal line and latitudinal line. Generating the alert can include transmitting a signal to at least one of a house alarm system, a cell phone, a personal computer, a pager, and a land line. In one or more embodiments, generating an alert can also include sounding an alarm. The sounding of the alarm and the transmission of a signal to at least one of a house alarm system, a cell phone, a personal computer, a pager, and a land line can occur simultaneously.

The method can also include generating a report on all the acquired data 750. For example, the acquired data can be sent to a processor or monitoring device and the monitoring device or processor can generate a weekly, daily, monthly or hourly report on all the acquired data.

Figure 8:
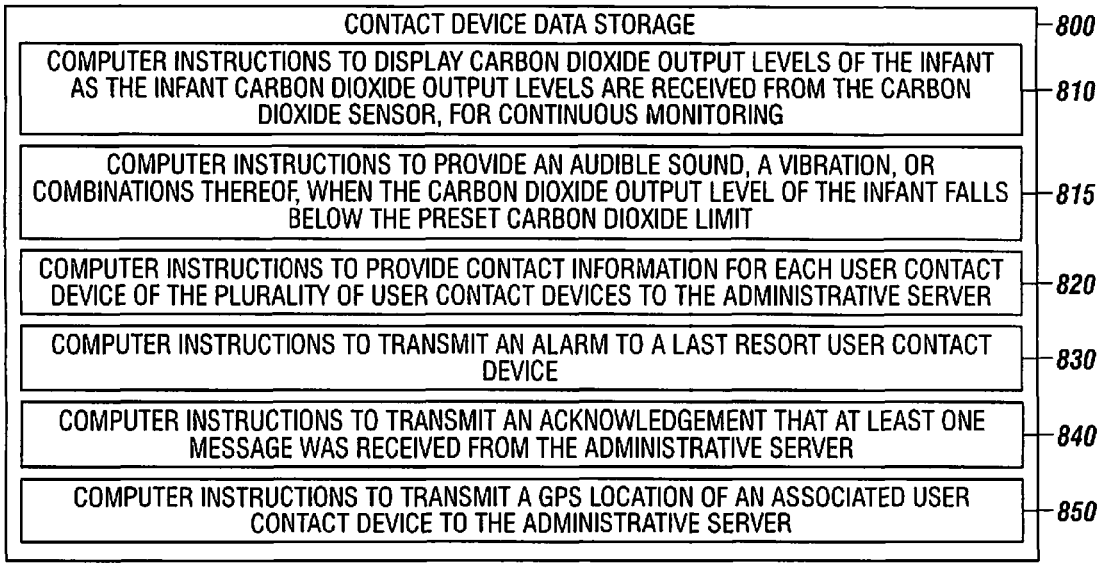
FIG. 8 depicts a schematic of a contact device data storage.

FIG. 8 depicts a schematic of a contact device data storage. The contact device data storage 800 can include computer instructions to display carbon dioxide output levels of the infant as the infant carbon dioxide output levels are received from the carbon dioxide sensor, for continuous monitoring 810; computer instructions to provide an audible sound, a vibration, or combinations thereof, when the carbon dioxide output level of the infant falls below the preset carbon dioxide limit 815; computer instructions to provide contact information for each user contact device of the plurality of user contact devices to the administrative server 820; computer instructions to transmit an alarm to a last resort user contact device 830; computer instructions to transmit an acknowledgement that at least one message was received from the administrative server 840; and computer instructions to transmit a GPS location of an associated user contact device to the administrative server 850.

While these embodiments have been described with emphasis on the embodiments, it should be understood that within the scope of the appended claims, the embodiments might be practiced other than as specifically described herein.

What is claimed is:

1. A system for monitoring carbon dioxide levels to prevent SIDS in an infant, the system comprising:

a. a wearable portion, the wearable portion comprising:

(i) a carbon dioxide sensor for detecting carbon dioxide output;

(ii) a wearable portion processor in communication with the carbon dioxide sensor for receiving carbon dioxide sensor data and for comparing the carbon dioxide sensor data to a preset carbon dioxide limit;

(iii) a wearable portion data storage in communication with the wearable portion processor for storing the preset carbon dioxide limit, wherein the wearable portion data storage has wearable portion computer instructions in communication with the wearable portion processor;

(iv) a signal transmitter in communication with the wearable portion processor for transmitting wearable portion signals; and (v) a signal receiver in communication with the wearable portion processor for receiving incoming signals;

b. a power supply in communication with the wearable portion;

c. an administrative server with an administrative processor and an administrative data storage; wherein the administrative data storage has administrative computer instructions; further wherein the administrative server is in communication with the wearable portion through a first network;

d. a plurality of user contact devices in communication with the administrative server; and e. a last resort user contact device in direct communication with the wearable portion.

2. The system of claim 1, wherein each user contact device of the plurality of user contact devices has a contact device processor, a contact device data storage, and contact device computer instructions, further wherein each user contact device of the plurality of user contact devices is in communication with the administrative server through the first network, a second network, or a combination of the first network and the second network.

3. The system of claim 2, wherein the contact device computer instructions comprise:

a. computer instructions to display carbon dioxide output levels of the infant as the carbon dioxide output levels of the infant are received from the carbon dioxide sensor, for continuous monitoring;

b. computer instructions to provide an audible sound, a vibration, or combinations thereof, when the carbon dioxide output levels of the infant falls below the preset carbon dioxide limit;

c. computer instructions to provide contact information for each user contact device of the plurality of user contact devices to the administrative server;

d. computer instructions to transmit an alarm to the last resort user contact device;

e. computer instructions to transmit an acknowledgement that at least one message was received from the administrative server; and f. computer instructions to transmit a GPS location of an associated user contact device to the administrative server.

4. The system of claim 1, wherein at least one contact device of the plurality of user contact devices is a home alarm system.

5. The system of claim 1, wherein the wearable portion computer instructions comprise:

a. computer instructions to compare sensed carbon dioxide output from the infant to the preset carbon dioxide limit for the infant, forming a compared value;

b. computer instructions to form and transmit a message to at least one user contact device of the plurality of user contact devices indicating when the compared value falls below or exceeds the preset carbon dioxide limit for the infant;

c. computer instructions to provide periodic transmissions of the compared value; and d. computer instructions to provide an emergency transmission simultaneously to the at least one user contact device of the plurality of user contact devices.

6. The system of claim 1, wherein the administrative computer instructions comprise:

a. computer instructions for forming at least one message;

b. computer instructions for transmitting the at least one message;

c. computer instructions to ensure contact between at least one user contact device of the plurality of user contact devices and the administrative server;

d. computer instructions to generate a report on received carbon dioxide sensor data, on comparison of the received carbon dioxide sensor data and the preset carbon dioxide limit, or combinations thereof;

e. computer instructions to track a date when the at least one message was transmitted to the at least one user contact device of the plurality of user contact devices;

f. computer instructions to track a time when the at least one message was transmitted to the at least one user contact device of the plurality of user contact devices;

g. computer instructions to obtain a GPS location of the at least one user contact device of the plurality of user contact devices;

h. computer instructions to retransmit the at least one message to at least one user contact device of the plurality of user contact devices closest to the infant;

i. computer instructions to receive, store, and track the GPS location of the at least one user contact device of the plurality of user contact devices;

j. computer instructions to track receipt of the at least one message;

k. computer instructions to display the GPS location of the at least one user contact device of the plurality of user contact devices on a map;

l. computer instructions to allow information on a location of a hospital to be attached to the at least one message; and m. computer instructions to allow an administrator to see the displayed GPS location of the at least one user contact device of the plurality of user contact devices simultaneously.

7. The system of claim 1, wherein the wearable portion is sewn into clothing of the infant.

8. The system of claim 1, wherein the preset carbon dioxide limit is determined by an age of the infant, a weight of the infant, a gender of the infant, an ethnicity of the infant, or combinations thereof.

* * * * *